US005795411A

United States Patent [19]

Terrien et al.

[11] Patent Number: 5,795,411

[45] Date of Patent: Aug. 18, 1998

[54] FERRITIC STAINLESS STEEL WIRE AND STEEL WOOL

[75] Inventors: Pascal Terrien, Elancourt; Pierre Pedarre, Annecy le Vieux; Bernadette Sicoli, Ugine; Claude Bioteau, Mercury, all of France

[73] Assignee: Ugine Savoie, Ugine, France

[21] Appl. No.: 743,152

[22] Filed: Nov. 4, 1996

[30] Foreign Application Priority Data

Nov. 3, 1995 [FR] France ..... 95 12976

[51] Int. Cl.[6] ..... C22C 38/18

[52] U.S. Cl. ..... 148/325; 420/41; 428/606

[58] Field of Search ..... 148/325; 420/41; 428/606

[56] References Cited

U.S. PATENT DOCUMENTS 5,427,635 6/1995 Bletton et al. .
5,496,515 3/1996 Pedorre et al. ..... 420/41

FOREIGN PATENT DOCUMENTS

A-0 403 332 12/1990 European Pat. Off. .
A-2 143 256 2/1973 France .
A-2 445 388 7/1980 France .
A-2 456 785 12/1980 France .
6145908 5/1994 Japan .

*Primary Examiner*—Deborah Yee
*Attorney, Agent, or Firm*—Oblon, Spivak, McClelland, Maier & Neustadt, P.C.

[57] ABSTRACT

Ferritic stainless steel which can be used for the production of steel wool, whose composition by weight is the following:

carbon≦0.2%,
silicon≦2%,
manganese≦2%,
11%≦chromium≦30%,
nickel≦1%,
sulfur≦0.030,
calcium≧$\times 10^{-4}$%,
oxygen≧40 $\times 10^{-4}$%, the calcium and oxygen contents satisfying the following relationship:

0.2≦Ca/O≦0.7.

11 Claims, 2 Drawing Sheets

FERRITIC STAINLESS STEEL WIRE AND STEEL WOOL

FIELD OF THE INVENTION

The present invention relates to a ferritic stainless steel which can be used for the production of steel wool.

Steel wool is obtained by a technique called shaving. The steel wool is produced on a shaving plant from a steel wire wound into one or more sheets of contiguous wires on rotationally driven rolls. A sheet of contiguous wires passes over cutting tools which produce shavings forming the wool. The depth of pass which corresponds to the thickness of the shaving is determined by the force of the tool pressing on the sheet of wires.

The speed at which the wire runs over the tools, which corresponds to a cutting speed, is about 30 meters per minute for shaving stainless steel wires and about 50 meters per minute for shaving soft steel wires.

The shavings which form the wool are driven towards the front of the plant where they are wound up on a cylinder.

The quality of the wool is evaluated as a function of criteria such as, for example:

the quantity of waste: the waste consists of debris or shavings which are not entrained by the sheet of steel wool, and very short shavings which drop off under the plant and are regularly collected by the operator in order to monitor the plant quantitatively and qualitatively. It is therefore necessary to obtain, during the shaving operation, long continuous shavings;

the quality of the wool: this is assessed by feel and by its visual appearance. A high-quality wool is homogeneous and soft. The presence of thick shavings due, for example, to tool wear gives a heterogeneous appearance and a less agreeable consistency. Monitoring by the operator is paramount since, at any moment, the pressure of the tools on the sheets of wires can alter.

SUMMARY OF THE INVENTION

The object of the invention is to propose a steel which, in wire form, can be used for shaving operations intended for the manufacture of steel wool.

The subject of the invention is a ferritic stainless steel which can be used for the production of steel wool. It is distinguished in terms of the following composition by weight:

carbon≦0.2%, silicon≦2%, manganese≦2%,

11%≦chromium ≦30%, nickel≦1%, sulfur≦0.030%, calcium≧$15\times10^{-4}$% oxygen≧$40\times10^{-4}$%, the calcium and oxygen contents satisfying the following relationship:

0.2≦Ca/O≦0.7;

the steel preferably has the following composition by weight:

carbon≦0.08%, silicon≦1%, manganese≦2%,

15%≦chromium≦19%, nickel≦1%, sulfur≦0.030%, calcium≧$15\times10^{-4}$% oxygen≧$40\times10^{-4}$%, the calcium and oxygen contents satisfying the following relationship:

0.2≦Ca/O≦0.7;

the steel preferably has the following composition by weight:

carbon≦0.1% silicon≦1%, manganese≦2%,

20%≦chromium≦28%, nickel≦1%, sulfur≦0.030%, calcium≧$15\times10^{-4}$% oxygen≧$40\times10^{-4}$%, the calcium and oxygen contents satisfying the following relationship:

0.2≦Ca/O≦0.7;

The other characteristics of the steel are:

the steel preferably has the following composition by weight:

calcium≧$30\times10^{-4}$%, oxygen≧$70\times10^{-4}$% the calcium and oxygen contents satisfy the following relationship:

0.3≦Ca/O≦0.6;

the composition furthermore contains less than 3% of molybdenum;

the composition furthermore contains less than 1% of the elements titanium, tantalum, zirconium and niobium, taken alone or in combination.

The invention also relates to a wire for the production of steel wool, this wire being obtained by wire drawing and containing inclusions of the anorthite and/or pseudo-wollastonite and/or gehlenite and/or tridymite type.

Description of the drawings

The description which follows and the appended figures, all given by way of nonlimiting example, will make the invention clearly understood.

FIG. 1 shows a diagram of a shaving plant 1.

Figure 1:
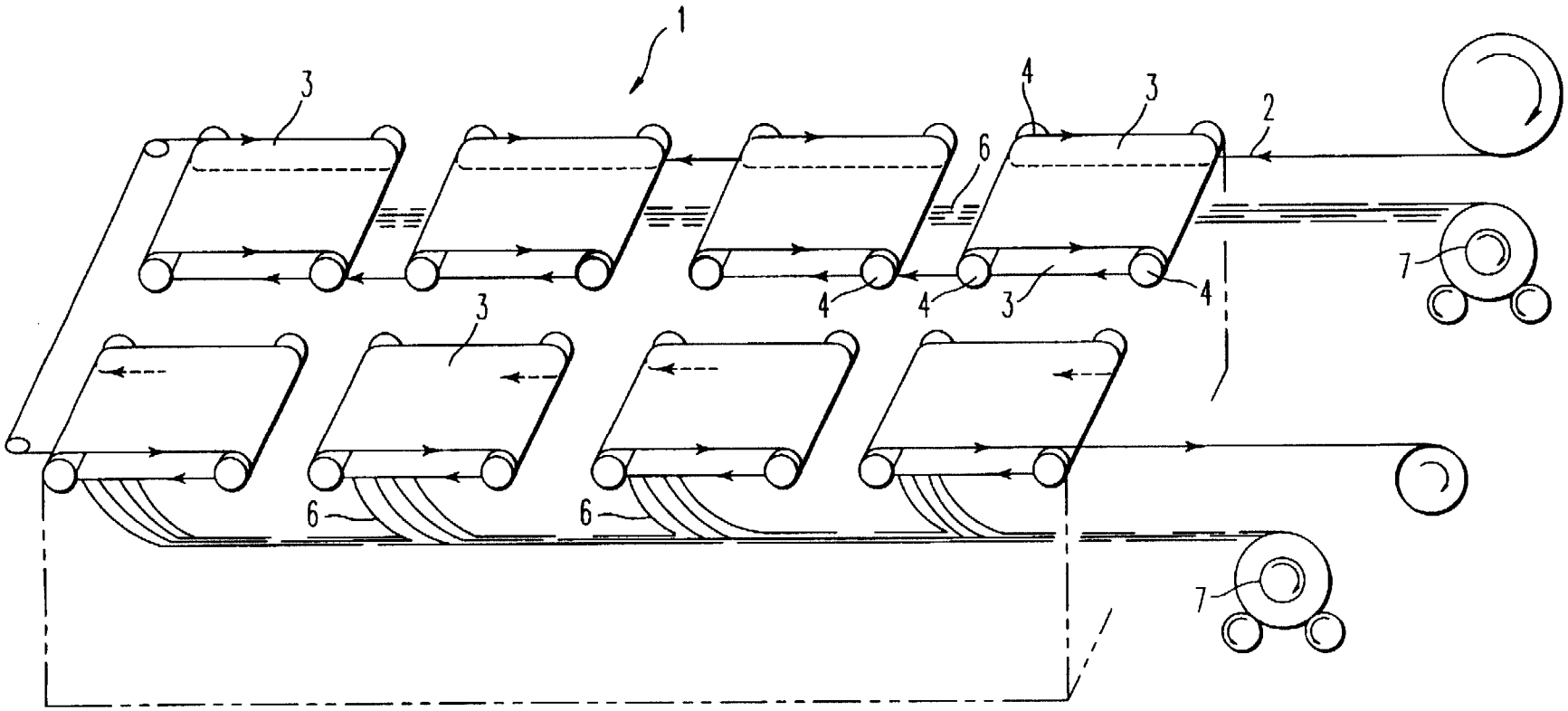
FIG. 1 is a diagram showing a plant for the production of steel wool.

For example, the size of the plant 1 is about 10 meters in length, 3 meters in width and 2 meters in height. The steel wire 2 intended to be shaved is wound in the form of sheets 3, between two rotationally driven rolls 4. A sheet 3 consists of approximately 15 contiguous wires 2.

Each of the sheets 3 moves over cutting tools 5, called combs, which produce shavings 6 forming the fibers of the steel wool.

The shavings 6 forming the fibers of the steel wool are driven toward the front of the plant and wound up onto a cylinder 7 for recovering the wool.

Figure 2:
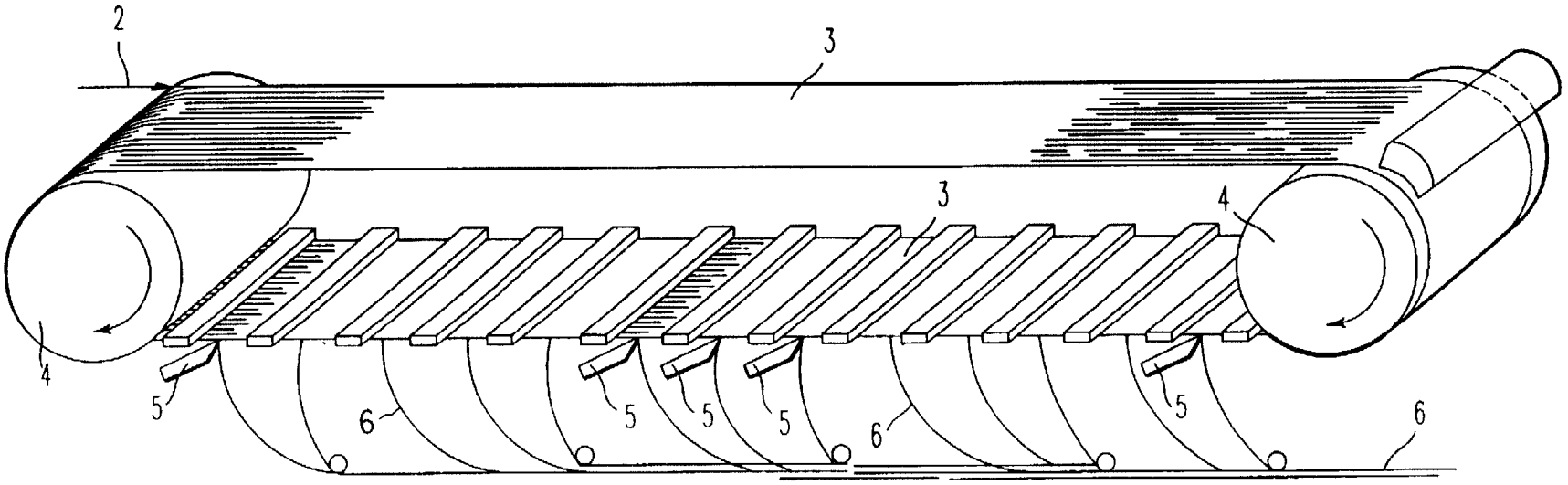
FIG. 2 is a perspective diagram of a winding, forming a bottom sheet and a top sheet of a plant.

FIG. 2 is a perspective diagram of a winding forming a bottom sheet 3 and a top sheet 3. The bottom sheet 3 passes over tools 5 in the form of cutters which are placed approximately perpendicularly to the movement of the wires 2. The tools 5 are made of high-speed steel and are made up, as cutting faces, of striations whose spacing defines a grade of steel wool or the width of the shavings 6.

The speed at which the wire 2 runs between the rolls 4, which corresponds to the cutting speed of the tools 5, is between 30 and 50 meters per minute, which speed has to remain relatively low in order to avoid overheating of the fine steel wool shavings 6.

The depth of pass of the shaving operation is provided by the force of the tools 5 pressing on the sheets 3 of wires 2. It is this force which defines the thickness of the shaving. The thickness of the shavings 6 is generally less than 50 micrometers, it being known for this to be commonly about 20 micrometers. The width of the shavings 6, which is a function of the comb or cutting tool 5, is usually about 50 to 70 micrometers.

Ultimately, these dimensions remain of the same order of magnitude as those of the inclusions, as indicated in Table 3. It is not uncommon for the steel in wire form to have inclusions having a width of about 15 micrometers, most of them having a width of between 5 and 15 micrometers.

Since the wire is subjected to the shaving operation in its length direction, it is in fact the width of the inclusions which have to be taken into consideration, their length having little effect on the shaveability. For the same quantity of inclusions, it is therefore necessary for a wire preferably to have elongate inclusions, this being confirmed by the illustrative embodiments which follow.

For those skilled in the art, the quality of the wool according to the criteria mentioned hereinabove is defined, on monitoring cards, by qualifying terms of the type: recommended, not recommended, rejected.

It seems that the quality of the wool is related to the nature and shape of the inclusions contained in the steel of the wires.

Steels with improved machinability for screw cutting, using carbide-coated tools working at high cutting speeds of about 200 meters per minute, are known. Screw cutting is the machining of small-diameter bars, necessitating limitations especially for the cutting speeds.

The behavior of these free-cutting steels is related to the characteristics of the inclusions, which inclusions, deformed by the machining and subjected to a temperature rise at the tip of the cutting tool, ensure, because of their softening, lubrication at the metal/tool interface, cooling of said tool and fragmentation of the skived chips. In this field of application, the chips coming from the machining must be short and discontinuous in order to ensure their removal, the machining being carried out at high speed.

In the field of the production of steel wool, it is observed that the ferritic stainless steel according to the invention of the following composition by weight:

carbon$\leqq$0.2%, silicon$\leqq$2%, manganese$\leqq$2%,

11%$\leqq$chromium$\leqq$30%, nickel$\leqq$1%, sulfur$\leqq$0.030, calcium$\geqq 15\times10^{-4}$%, oxygen$\geqq 40\times10^{-4}$%, the calcium and oxygen contents satisfying the following relationship:

0.2$\leqq$Ca/O$\leqq$0.7, gives a steel wool of improved quality both from the standpoint of the appearance of the fiber and from the standpoint of productivity.

The steel according to the invention may furthermore contain titanium, tantalum, zirconium and niobium which improve the oxidation resistance. The introduction of molybdenum in the composition of the steel improves the corrosion resistance and the hot strength.

The steel according to the invention, produced in wire form, has inclusions which are deformed after rolling and wire drawing, the width of which inclusions is less than 5 micrometers, the inclusions being aluminosilicates of lime of the anorthite and/or pseudo-wollastonite and/or gehlenite and/or tridymite type.

The properties of the steel from a mechanical standpoint such as, for example, the cohesion between the inclusions and the matrix of said steel, ensure good quality of the fiber for steel wool. Moreover, the steel is tailored for shaving-type machining at low cutting speed. From the standpoint of the composition, carbon is an element which tends to stabilize the austenitic phase compared to the ferritic phase. Furthermore, this element is not very soluble in ferrite at room temperature. Given the high value of the diffusion coefficient of carbon in the body-centred cubic matrix of the ferrite, it follows that unless the concentration of this element is lowered to below very low contents it is very difficult to limit the precipitation of chromium carbides at room temperature.

At the same time, these chromium carbides obviate the use of chromium and are surrounded by chromium-depleted regions. The corrosion resistance of the material therefore is degraded. It may be preferable to reduce the carbon content to less than 0.08%. However, carbon enhances the mechanical properties of the steel and, for some applications, the carbon content may be as high as 0.2%.

The fact of having low calcium and oxygen contents, while satisfying the Ca/O ratio, makes it possible to obtain excellent behavior of the steel during the shaving operation. It has been noticed that the presence of more than $30.10^{-4}$% of calcium and more than $70.10^{-4}$% of oxygen was also favorable. It is thus possible to avoid extensive deoxidation during smelting of the steel on condition, however, of having a Ca/O ratio of between 0.2 and 0.7. Steels having from 15 to 19% of chromium are widely used and are satisfactory in current applications. They may be improved, especially from the intergranular corrosion standpoint, by the addition of elements such as titanium, niobium and zirconium. Another way of improving them, which is effective but expensive, consists in increasing the chromium content. The resistance to both cavertation corrosion and pitting corrosion is greatly improved when the chromium contents are between 20 and 30%.

Table 1 shows 6 steels, three of them being reference steels and steels A, B, C being steels according to the invention.

TABLE 1

| | ref. steel 1 | ref. steel 2 | ref. steel 3 | steel A | steel B | steel C |
|---|---|---|---|---|---|---|
| carbon, % | 0.040 | 0.038 | 0.037 | 0.042 | 0.036 | 0.039 |
| silicon, % | 0.37 | 0.36 | 0.45 | 0.38 | 0.36 | 0.39 |
| manganese, % | 0.39 | 0.41 | 0.32 | 0.37 | 0.40 | 0.35 |
| nickel, % | 0.21 | 0.028 | 0.42 | 0.31 | 0.24 | 0.17 |
| chromium, % | 16.4 | 16.4 | 16.4 | 16.3 | 16.4 | 16.3 |
| molybdenum, % | 0.94 | 0.76 | 0.6 | 0.93 | 0.72 | 0.81 |
| copper, % | 0.09 | 0.30 | 0.15 | 0.27 | 0.10 | 0.08 |
| nitrogen, $10^{-4}$% | 45 | 58 | 42 | 53 | 39 | 48 |
| sulfur, $10^{-4}$% | 131 | 182 | 192 | 172 | 105 | 121 |
| calcium, $10^{-4}$% | >2 | >2 | 54 | 24 | 16 | 55 |
| oxygen, $10^{-4}$% | 65 | 45 | 75 | 85 | 51 | 120 |
| Ca/O | 0 | 0 | 0.72 | 0.28 | 0.31 | 0.46 |

Table 2 shows the mechanical properties of the above-mentioned steels, said shaving steels being in the form of wire 3.1 mm in diameter.

TABLE 2

| | ref. steel 1 | ref. steel 2 | ref. steel 3 | steel A | steel B | steel C |
|---|---|---|---|---|---|---|
| $R_m$ (MPa) | 966 | 1045 | 1070 | 1021 | 960 | 1015 |
| $R_{p0.2}$ (MPa) | 860 | 948 | 800 | 839 | 880 | 754 |
| Z, % | 62 | 62 | 36 | 64 | 40 | 35 |

Table 3 summarizes the nature of the inclusions in the steels of the description.

TABLE 3

| | Width of oxide inclusions (μm) | Nature of the dominant oxides |
|---|---|---|
| ref. steel 1 | 5 to 15 | $Al_2O_3$—$SiO_2$—$CrO_3$—MnO + $Al_2O_3$—MgO |
| ref. steel 2 | 5 to 15 | $Al_2O_3$MgO |
| ref. steel 3 | 3 to 8 (globular inclusions) | CaO—$Al_2O_3$—$SiO_2$ |
| steel A | <2 | $Al_2O_3$—$SiO_2$—CaO |
| steel B | <2 | $Al_2O_3$—$SiO_2$—CaO |
| steel C | <2 | $Al_2O_3$—$SiO_2$—CaO |

Table 4 summarizes characteristics obtained in shaving operations carried out on the reference steels and the steels according to the invention, as well as the assessment of the quality of the wool.

TABLE 4

| | Weight per meter after | | | | Resid. | Comb | Wool | |
|---|---|---|---|---|---|---|---|---|
| | 1 h | 3 h | 5 h | 8 h | wear | thick. | appearance | Assessment |
| ref. steel 1 | 90 | 92 | 95 | 100 | 75/80 | poor | poor | to be rejected |
| ref. steel 2 | 100 | 105 | 106 | 115 | 70/75 | poor | average | not recommended |
| ref. steel 3 | 110 | 112 | 113 | 118 | 69/72 | poor | average | not recommended |
| steel A | 145 | 147 | 149 | 150 | 65/68 | normal | good | recommended |
| steel B | 130 | 132 | 135 | 137 | 70/72 | normal | good | recommended |
| steel C | 151 | 152 | 152 | 154 | 45/50 | good | good | recommended |

Comparison between reference steels 1, 2 and 3, presented hereinabove, and steels A, B, C according to the invention shows that the inclusions occurring naturally, after smelting the reference steel and forming it into a wire for shaving, have a large width. Furthermore, they are by nature hard and abrasive. The inclusions contained in the shaving wire according to the invention are elongate and their width is significantly less than the inclusions contained in the reference steels. This elongation of the inclusion results in a low flow stress for said inclusions and consequently a reduced hardness compared to that of the reference steels.

Table 4 demonstrates the gains in steel-wool productivity resulting from the use of the steels according to the invention. This is because the weight per meter of wool is markedly higher with the steels according to the invention and the thickness of the residual wire is smaller, thereby reducing the raw-material losses.

Furthermore, observation regarding the wear of the combs or cutting tools is testimony of the deleterious effect of the hard and abrasive inclusions. The tools used for shaving the reference steels wore out rapidly compared to the wear of the tools used for shaving the steels according to the invention. In addition, from the standpoint of the appearance of the steel wool obtained by shaving, it may be noticed that the wool has a better quality when it is obtained by shaving the steels according to the invention. In other words, the inclusions of the $Al_2O_3$ —$SiO_2$—CaO type satisfy, from the standpoint of elemental contents, the Ca/O ratio, which lies between 0.2 and 0.7.

It may also be noted, in the analysis of the properties in Table 2, that very good mechanical properties tend to improve the shaveability of the steels.

The invention does not consist in introducing into the steel a quantity of inclusions of a certain type but consists in smelting a steel which contains inclusions inherent in its smelting, the smaller number of inclusions being, according to the invention, inclusions of aluminosilicates of lime.

In summary, the invention consists mainly in a modification of the nature of the residual oxide inclusions without seeking to increase their density, so as to obtain, after rolling and wire drawing, residual inclusions of a small width.

By monitoring the inevitable appearance of oxides of such a kind as defined by the invention, it is possible to improve the productivity and quality of the steel wool obtained by a shaving operation, by generating long and uniform shavings at low machining speeds using tools made of high-speed steel.

We claim:

1. Steel wire obtained by wire drawing ferritic stainless steel comprising, by weight, carbon≦0.2%, silicon≦2%, manganese≦2%, 11%≦chromium≦30%, nickel≦1%, sulfur≦0.030%, calcium≧$15\times10^{-4}$% oxygen≧$40\times10^{-4}$%, the calcium and oxygen contents satisfying the following relationship:

0.2≦Ca/O≦0.7.

2. The steel wire as claimed in claim 1 wherein said ferritic stainless steel comprises, by weight:

carbon≦0.08%, silicon≦1%, manganese≦2%,

15%≦chromium≦19%, nickel≦1%, sulfur≦0.030%, calcium≧$15\times10^{-4}$% oxygen≧$40\times10^{-4}$%, the calcium and oxygen contents satisfying the following relationship:

0.2≦Ca/O≦0.7.

3. The steel wire as claimed in claim 1 wherein said ferritic stainless steel comprises, by weight:

carbon≦0.1%, silicon≦1%, manganese≦2%,

20%≦chromium≦28%, nickel≦1%, sulfur≦0.030%, calcium≧15×10$^{-4}$% oxygen≧40×10$^{-4}$%, the calcium and oxygen contents satisfying the following relationship:

0.2≦Ca/O≦0.7.

4. The steel wire as claimed in claim 1 wherein said ferritic stainless steel comprises by, weight:

calcium≦30 ×10$^{-4}$% oxygen≦70×10$^{4}$%.

5. The steel wire as claimed in claim 1, wherein the calcium and oxygen contents of said ferritic stainless steel satisfy the following relationship:

0.3≦Ca/O≦0.6.

6. The steel wire as claimed in claim 1, wherein said ferritic stainless steel contains less than 3% of molybdenum.

7. The steel w as claimed in claim 1, wherein said ferritic stainless steel contains less than 1% of the elements titanium, tantalum, zirconium and niobium, taken alone or in combination.

8. The steel wire as claimed in claim 1, which contains inclusions of the anorthite and/or pseudowollastonite and/or gehlenite and/or tridymite type.

9. Steel wool comprising ferritic stainless steel, wherein said ferritic stainless steel comprises, by weight, carbon≦0.0.2%, silicon≦2%, manganese≦2%, 11%≦chromium ≦30%, nickel≦1%, sulfur≦0.030%, calcium≧15×10$^{-4}$% oxygen≧40×10$^{-4}$%, the calcium and oxygen contents satisfying the following relationship:

0.2≦Ca/O≦0.7.

10. The steel wool of claim 9, wherein said ferritic stainless steel comprises, by weight, carbon≦0.08%, silicon≦1%, manganese≦2%, 15%≦chromium≦19%, nickel≦1%, sulfur≦0.030%, calcium≧15×10$^{-4}$% oxygen≧40×10$^{-4}$%, the calcium and oxygen contents satisfying the following relationship:

0.2≦Ca/O≦0.7.

11. The steel wool of claim 9, wherein said ferritic stainless steel comprises, by weight, carbon≦0.1%, silicon≦1%, manganese≦2%, 20%≦chromium≦28%, nickel≦1%, sulfur≦0.030%, calcium≧15×10$^{-4}$% oxygen≧40×10$^{-4}$%, the calcium and oxygen contents satisfying the following relationship:

0.2≦Ca/O≦0.7.

* * * * *